US005197368A

United States Patent [19]

Meyer et al.

[11] Patent Number: 5,197,368

[45] Date of Patent: Mar. 30, 1993

[54] PUNCH AND DIE RETAINER AND RELEASE MECHANISM

[75] Inventors: David G. Meyer, Centerville; Robert L. Shadowens, West Carrollton, both of Ohio

[73] Assignee: Dayton Progress Corporation, Dayton, Ohio

[21] Appl. No.: 961,461

[22] Filed: Oct. 15, 1992

Related U.S. Application Data

[63] Continuation-in-part of Ser. No. 751,875, Aug. 28, 1991, abandoned.

[51] Int. Cl.[5] ..... B26F 1/14

[52] U.S. Cl. ..... 83/698; 83/686

[58] Field of Search ..... 83/691, 698, 686; 279/30, 39

[56] References Cited

U.S. PATENT DOCUMENTS

| | | | |
|---|---|---|---|
| 1,621,811 | 3/1927 | Richard et al. | 83/698 |
| 2,217,560 | 10/1940 | Michon . | |
| 2,382,267 | 8/1945 | Stellin | 83/698 |
| 3,563,124 | 2/1971 | Gargrave . | |
| 4,096,776 | 6/1978 | Laucke . | |
| 4,558,620 | 12/1985 | Wallis . | |
| 4,698,459 | 8/1987 | Osborn et al. . | |
| 4,949,449 | 8/1990 | Wilson . | |

*Primary Examiner*—Hien H. Phan
*Attorney, Agent, or Firm*—Biebel & French

[57] ABSTRACT

An improved ball-type punch retainer for holding and releasing the shank of a punch or a die includes a retainer body with a shank-receiving opening which extends into the body, and a locking ball is movable by a spring in an inclined hole in the retainer body into locking engagement with a tear-dropped shaped recess formed in the side of the shank. A tool access ball releasing slot is formed through a side wall of the retainer body and extends into the ball hole, to permit a tool to be inserted through the slot and into engagement with the locking ball, at a position between the center of the ball and the lower face of the retainer body. In one embodiment, the ball release access slot extends transversely through the body so that a tool may be inserted through either end of the slot into engagement with the locking ball and is operable to lift the ball against a biasing spring and to dislodge a jammed ball. A tool in the form of a rectangular bar has an inclined or tapered nose at one end, forming a ball-lifting surface, and has an upper ball-retaining surface on its upper end whereby the tool may be inserted and allowed to remain in place hands free while holding the ball in the released position. The ball access slot is positioned in non-intersecting relation to the three ball contact positions between the ball, the punch shank, and the retainer body.

5 Claims, 5 Drawing Sheets

PUNCH AND DIE RETAINER AND RELEASE MECHANISM

RELATED APPLICATION

This application is a continuation-in-part of Ser. No. 751,875 filed Aug. 28, 1991, now abandoned.

BACKGROUND OF THE INVENTION

Metal punches and dies are commonly retained in a retainer assembly by a diagonally movable keeping or locking ball. The locking ball is spring-biased into a seated position partially within a tapered ball groove formed in a side wall of the shank of the punch or die, and is retained by a diagonal ball-retaining hole or opening formed in the body of the retainer. In the case of a punch, the access opening in the retainer body for the shank of the punch is usually in a lower face surface of the retainer. Commonly, in the removal of the punch or die from the retainer, the ball is lifted against the spring bias by the insertion of a release tool through a small access opening in the lower face surface of the retainer. In the case of a punch, an upward force on the release tool causes the ball to ride up in its diagonal hole against the spring bias and out of engagement with the locking recess formed on the side of the punch shank, thereby permitting the shank to be withdrawn from the retainer.

Examples of such a locking ball retainer system for punches and dies are shown in U.S. Pat. Nos. 2,217,560 issued Oct. 8, 1940; 3,563,124 issued Feb. 16, 1971; and 4,558,620 issued Dec. 17, 1985. A particularly accurate illustration of a retainer or ball locking arrangement is that shown in Gargrave, U.S. Pat. No. 3,563,124. For the purpose of this invention, the following description is defined in terms of the support and release of a punch, although it will be understood by those skilled in the art that the concepts may be applied with equal facility to the retention and release of a die. Also, as illustrated in the above patents, the punch or tool being retained, is formed with a generally cylindrical shank or body which extends outwardly of the retainer through a retainer access opening formed in a face thereof, and continues to extend cylindrically in such a manner that the punch itself does not obstruct or interfere with an adjacent tool access opening, also formed in the retainer face, permitting for the insertion of a retainer ball-lifting tool so that the punch body may be removed from the retainer. A typical release tool is illustrated by the reference numeral 48 in U.S. Pat. No. 4,558,620.

The locking ball retainer system for punches and dies, as shown in the above identified patents and as refined over the years, has enjoyed widespread acceptance due to its simplicity, and more importantly, due to the high accuracy by which the shank of the punch or die may be seated and held in a locked position. The ball retention hole has a diameter which slightly exceeds that of the seating ball, while the tapered "tear drop" recess formed in the tool shank has a radius which is slightly less than that of the seating ball. When the ball is in its seated position, it makes contact at only three points. One contact point is against that of the wall of the retention hole at a position diametrically opposite to the shank. The other two contact points are at the lines of juncture between the tear drop recess and the cylindrical surface from which the recess has been cut. In this manner the ball is held stable in its seated or locking position.

However, during repeated impacts or long periods of use, the ball can become jammed or stuck in the seated position. In order to unseat the ball, an operator may be required to use both hands to push with a conventional lifting tool through the bottom tool access opening. The ball may also be dislodged by tapping the tool with a hammer, for the purpose of jarring the ball out of its seated position in which it may be jammed.

In many instances, the ball release access opening in the retainer bottom face surface is poorly positioned to permit the release of the ball with convenience and with the least risk of injury in the case of a machine malfunction. Although the release tools are designed so that the operator should not place his hands in a dangerous position, a ball which has become jammed or stuck could result in a compromise of safety while it is being released. Also, after the ball is dislodged, such tools commonly lack any means for holding the ball in a released position, against the spring bias, while the punch is removed from the retainer.

Accordingly, there exists a need for an improved punch or die retainer by which the locking ball may be released from a side location on the retainer, as distinguished from a face location, by which the locking ball can easily be dislodged in the event it is jammed in place, and by which the retainer may be operated with a high degree of safety and convenience.

In particular circumstances, it may also be desirable to utilize a punch in which the punch body external of the retainer is substantially wider than its retaining shank. When such punches are in position, the external body of the punch may cover or obscure the locking ball access opening in the retainer face, making it difficult, if not impossible, to insert the ball release tool. Accordingly, for such occurrences, there is required some means for releasing the retainer ball through a side of the retainer rather than through the bottom face.

SUMMARY OF THE INVENTION

The invention is directed to improved ball lock retainers for punches and dies which provide for ball release by access through a surface other than through the face surface of the retainer, that is, the surface in common with the die or punch opening therethrough.

In such a ball lock retainer, a locking ball is captured in and moves through a ball retainer hole, the axis of which is diagonal to the axis of the punch. A peripheral portion of the ball, in the locking position, rolls into camming engagement with a "tear-drop" recess formed in one lateral side of the shank of the punch. This recess is formed on an angle which is less than the angle of the ball retention hole to the axis of the punch. For example, the ball retention hole is commonly set at 15° to the punch axis, while the tear-drop recess is set at 12° to the punch axis. Thus, in the locking position, the ball does not roll to the bottom of the shank recess where control would be lost, but rolls downwardly and cam locks the shank of the punch at a position which is somewhat spaced from the bottom of the tear drop recess and from the bottom of the ball retention hole. Such movement is under the influence of a compression spring in the ball hole and bearing on the ball.

As noted above, in the seated or locking position, the ball is designed to contact the tear-drop recess of the punch at two lateral positions equally spaced from a center line. Further, the diametrically opposite side of the ball is designed in such position to come into contact with the opposite wall of the ball hole, so that the ball is retained with forces applied at three spaced points. In one aspect of the invention, an elongated access opening or slot is formed in a side wall of the retainer. This slot intersects the ball retention hole of the retainer in such a manner that it does not interfere with the critical contact points of the ball in the locked position. Further, the access slot extends to a position where the tip or end of a ball lifting tool may be inserted into the free space between the ball and the bottom of the ball retainer hole.

The access slot provides or forms a pry or pivot wall, adjacent the point at which the access slot enters the retainer, by means of which a pivotal motion may be applied to a ball lifting tool, by pressing in a direction opposite to that of ball movement, so as to lift the locking ball against the spring bias, thereby releasing the punch. In one embodiment, provision is made for a ball retention pin to be inserted after the ball has been raised or moved to an unlocked or shank releasing position, for retaining the ball in its unlocked position, thereby freeing both hands for removing the punch body from the retainer.

In another aspect of the invention comprising a preferred embodiment thereof, an access opening is formed in a side wall of the retainer body in intersecting relation to the inclined ball retaining hole, which access opening intercepts and extends beyond the hole to provide for the insertion of a ball lifting and retaining tool. The access opening is in non-interfering relation with the ball contact points, as previously defined. An elongated ball lifting tool is provided in the form of a bar or the like which has a tapered point. A lower end of the bar is carried by a bottom wall of the access opening or slot so that the tapered point engages the retention ball below its transverse center and causes the ball to be lifted out of locking position.

A remote end of the operator or lifting bar extends outwardly from the retainer body, when such bar is inserted. The remote end may be tapped by an impact device, such as a brass hammer, for the purpose of dislodging the ball from its locking position in the event it is jammed or otherwise wedged in place.

The tapered point provides a cam or lifting surface, as the bar is inserted, to cause the ball to ride up in its slot along the sloping surface of the point. The bar access slot is extended transversely of the ball opening, so that the bar point may pass through the ball opening and transversely there beyond, providing for the ball to be retained by a top surface of the bar as long as the bar is inserted. At that time, the shank of the punch or the die, as the case may be, may be readily extracted or withdrawn from the retainer.

In the preferred embodiment, the access slot extends transversely entirely through the retainer in generally normal or right-angled relation to the axis of the shank-receiving opening. This permits the bar to be inserted and the ball to be released from either of two opposite retainer sides. Once the bar has been inserted and the ball is lifted, the bar is self-holding, thereby permitting an operator to have both hands free for the removal and/or insertion of the cylindrical shank of a punch within the retainer.

A particular advantage of the preferred embodiment of this invention resides in its versatility as well has its enhanced safety. The locking ball can be lifted to its release position and held, in instances where the conventional ball release tool operating through the bottom face of the retainer cannot be used. Such instances occur when the conventional ball release hole is inaccessible to a tool, such as where the punch is large and covers the hole, or the release tool itself is too long and cannot be fitted into place. Also, it provides a convenient means of unlocking, lifting and holding the ball, permitting the operator to use both hands for other tasks.

A retainer formed with a transverse slot oriented generally parallel to the axis of the punch in non-intersecting relation to the critical ball contact points, permits the use, not only of the lifting tool described above, it also permits the use of a round pointed pry tool to obtain a lever action on the ball through a lower floor or wall of the slot, from two lateral sides of the retainer.

An object and advantage of the invention resides in the provision of an access slot provided in a wall of a punch retainer by means of which the locking ball may be released by access through a lateral position, which position is unobstructed by the punch itself.

A particular object of the invention is the provision of the ball-type punch retainer having an access slot or opening for release of the locking ball and for retention of the locking ball in the releasing position where the punch body may otherwise make it inconvenient or difficult to release the locking ball through the conventional ball release opening.

A still further object of the invention is the provision, in a ball-type punch retainer, of an elongated access slot through a side wall of the retainer which slot intersects the locking ball retention hole at a non-pressure or thrust-receiving region, to permit access for the entry of a ball lifting tool.

These and other objects and advantages of the invention will be apparent from the following description, the accompanying drawings and the appended claims.

BRIEF DESCRIPTION OF ACCOMPANYING DRAWINGS

DESCRIPTION OF PREFERRED EMBODIMENTS

Figure 3:
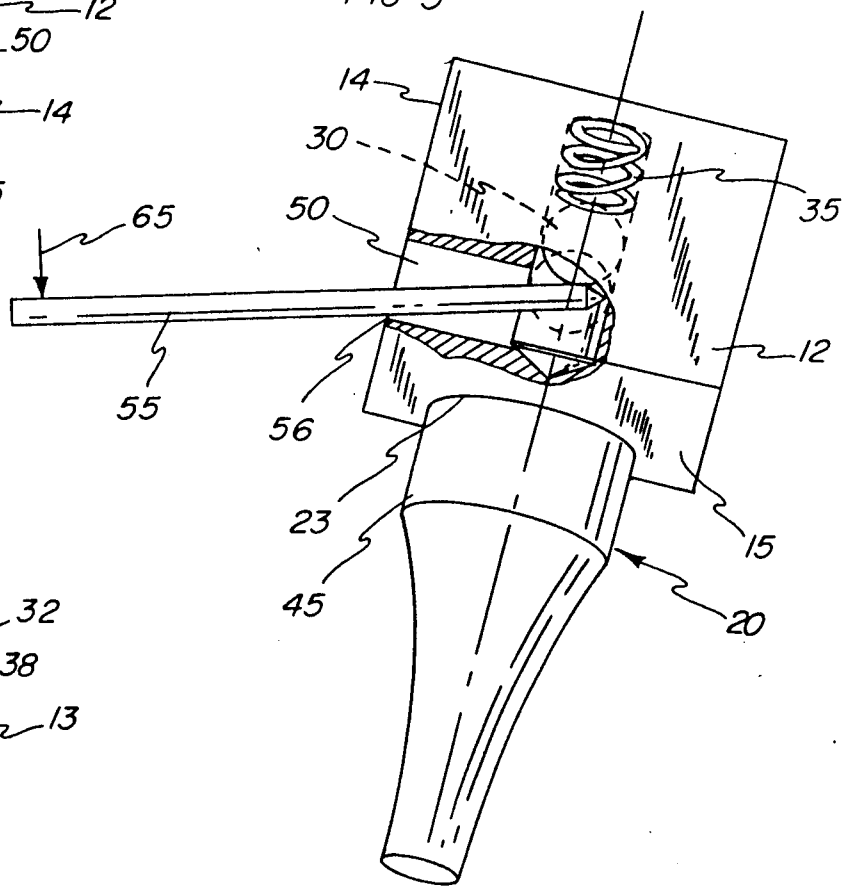
FIG. 3 is a perspective view of the retainer, looking at one side thereof.
Figure 1:
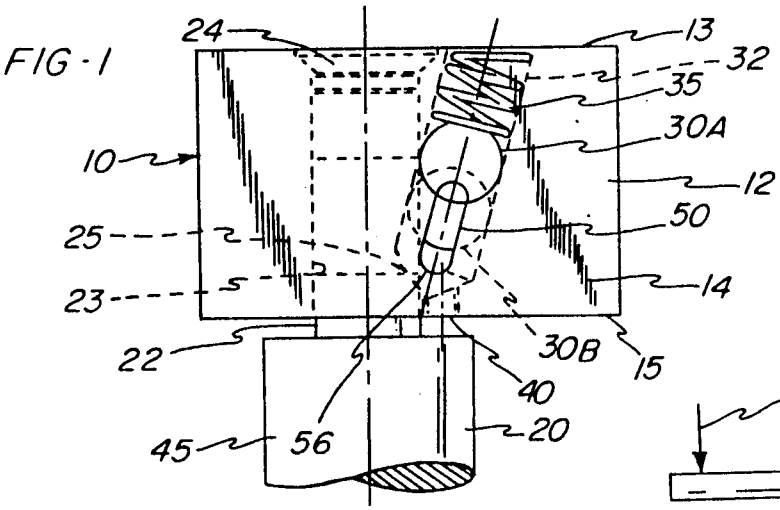
FIG. 1 is a side elevation of an embodiment of a retainer made in accordance with this invention.
Figure 2:
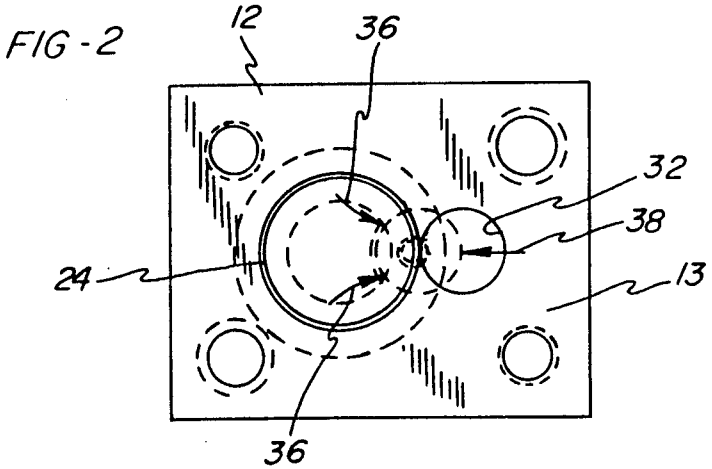
FIG. 2 is a top elevation of the retainer of FIG. 1.

A retainer assembly in accordance with one embodiment of this invention is illustrated generally at 10 in FIGS. 1-3. The retainer assembly includes a retainer body 12 which may be of rectangular configuration or may be of triangular configuration as illustrated in U.S. Pat. No. 3,563,124, previously mentioned above. The retainer body includes an upper mounting surface 13 which may be mounted on a backing plate or may be directly mounted to a die shoe, not shown, and includes one or more side surfaces or walls 14, and a bottom face 15.

The retainer assembly 10 retains a punch 20, in which a cylindrical shank 22 extends through an opening 23 formed in the face 15 and into the interior of the retainer 12. The upper end of the bore or shank opening in the retainer may be closed by an impact insert 24, as described in U.S. Pat. No. 3,563,124.

Figure 10:
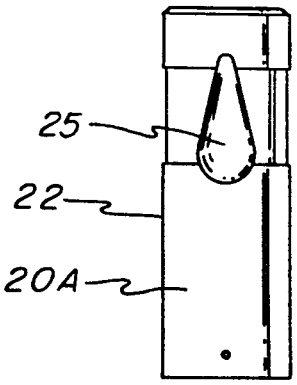
FIG. 10 is a side elevation of the shank of a punch showing the teardrop shaped ball-receiving recess.

A teardrop shaped ball seating recess 25 is formed in one lateral outer surface of the shank 22 (FIG. 10). This teardrop locking recess may be identical to that recess defined by the same reference numeral in the above patent '124 and is adapted to receive a hard steel locking ball 30. Usually the ball 30 is made of the same material as that of a bearing ball.

The ball 30 is positioned for movement between a retracted shank-releasing position shown at 30*a* in FIG. 1 and a lowered shank locking condition or position, shown at 30*b* in FIG. 1, and for this purpose is mounted in a diagonal bore hole 32, which hole forms a close fit with the ball on the sides of the ball. The axis of the hole 32 is at an angle to the axis of the shank 22, such as approximately 15°, while the ball locking recess 25 is typically at an angle of about 12° to this axis.

The locking ball 30 is urged into its locking position 30*b* by means of a compression coil spring 35 received in the upper end of the bore hole 32 and is retained therein by any suitable means. The spring 35 urges the ball 30 into the locking position. In this locking position, the ball 30, as shown at 30*b*, does not ride either to the bottom of the hole 32 or to the bottom of the teardrop recess 25, but assumes an intermediate position. Also, in this position, the ball contacts the recess 25 at two equally spaced positions as represented by the arrows 36 in FIG. 2, and the backside of the ball is in engagement with the adjacent wall of the hole 32 at the position indicated by the arrow 38 and opposite the tool shank recess. In this manner, the ball provides a positive lock for the punch 20.

The conventional arrangement for releasing the punch, by lifting the ball out of the seated or locking position, includes an access opening 40 formed in the face 15 which opens into the bottom of the hole 32 and permits, under normal conditions, the entry of the tip of a released tool, for lifting the ball 30. As previously noted, a typical such tool is illustrated in U.S. Pat. No. 4,558,620.

FIGS. 1-3 illustrate a condition where the punch 20 is provided with an enlarged bottom portion 45 external of the retainer face 15 which obscures or renders unaccessible the conventional opening 40. For the purpose of the present invention, the body 12 is formed with a tool access slot 50. The slot 50 extends through a side wall 14 of the retaining body 12 laterally onto the ball hole 32 in intersecting relation thereto. In the embodiment of FIGS. 1-3, the slot 50 is elongated and aligned on or near the axis of the hole 32. The slot 50 opens into the hole 32 at a location adjacent the ball 30 when the ball is in the locking position 30*b* so that a pry tool 55 can be inserted therethrough, just under the ball.

The slot 50 is formed with a lower pry wall 56, against which the ball lifting tool 55 may be leveraged, as illustrated in FIG. 3, for lifting the ball 30 against the compression spring 35, thereby effecting release of the punch 20 from the retainer body 12. As will be seen by reference to FIG. 2, the vertically elongated slot 50 intersects the ball hole 32 at a region which does not interfere with the three locating points defined by the arrows 36 and 38. Also, the open side of the slot 50 is positioned on a side wall or surface 14 of the body 12 which remains accessible in spite of the diameter of the tool 20.

Figure 6:
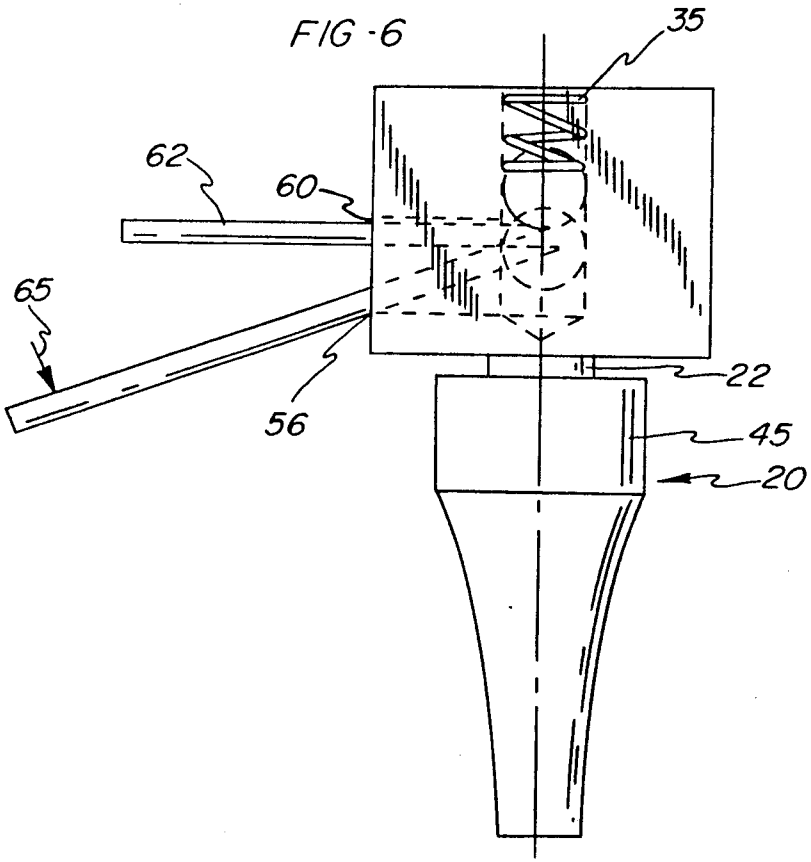
FIG. 6 is a side elevation of the retainer of FIG. 4.
Figure 4:
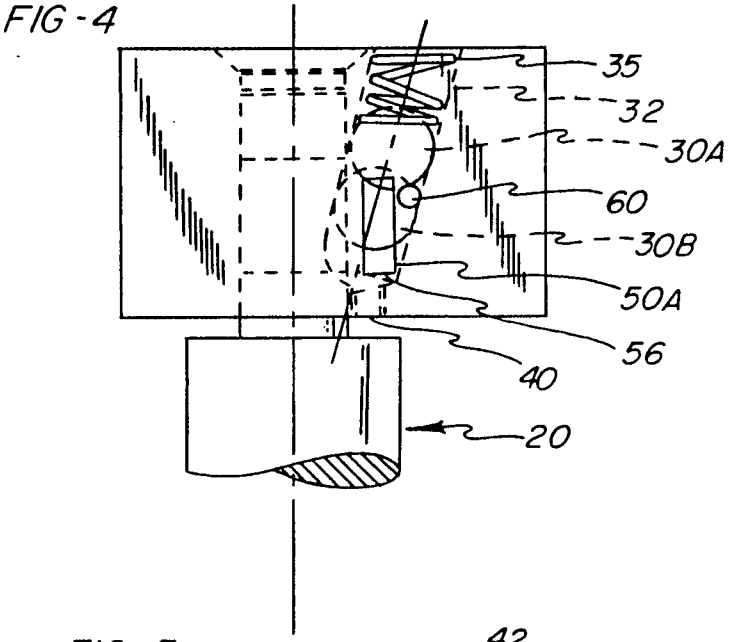
FIG. 4 is a side elevation of a modified form of the retainer.
Figure 5:
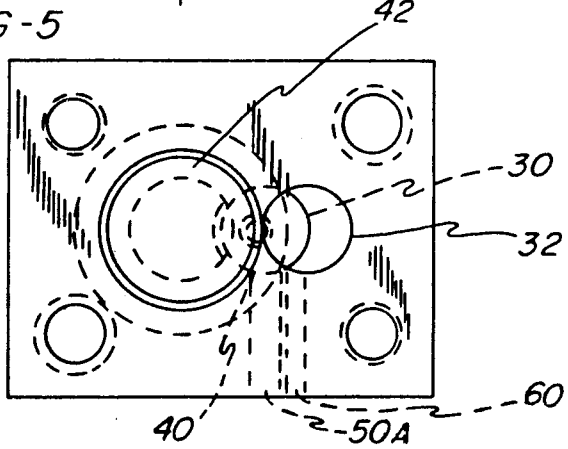
FIG. 5 is a top view of the retainer of FIG. 4.

The embodiment of FIGS. 4-6 illustrate a modified version of the slot represented by reference numeral 50*a*. In FIGS. 4-6, the slot 50*a* is of rectangular configuration, in cross-section, a form which may be made by Electro Discharge Machining, and is vertically aligned parallel to the axis of the punch itself. Nevertheless, it is carefully positioned so as to have an inner end in intersecting relation of the ball hole 32 so as not to interfere with the previously defined contact point between the ball and the wall of the hole 32. However, the vertical alignment of the slot 50*a* provides space for the drilling of a keeper opening 60. The opening 60 is positioned on an axial parallel to the alignment of the slot 50*a*, just beneath the ball in the ball released position 30*a*, and permits the insertion of a keeper pin 62, FIG. 6, for retaining the ball 30 in this released elevated position. In this manner, the operator has both hands free for the removal of the punch body from the retainer.

The operation of the invention of FIGS. 1-6 is largely self-evident from the foregoing description. As illustrated in FIGS. 4 and 6, the pry tool 55, which may be formed with a conical or pointed end, is inserted into the slot 50 and 50*a* and under the locking ball 30 in its locking position 30*b*. At that time, the lever or tool 55 is moved in the direction of the arrow 65 and brought down against the pry wall 56, thereby lifting the ball 30 into its retracted or released position 30*a* and out of engagement with the punch shank. After lifting, a keeping pin 62 may be inserted int the opening 60 in the embodiment of FIGS. 4-6, thereby retaining the locking ball in its retracted position against the compression spring 35.

A further and preferred form of the invention is shown in FIGS. 7 through 12, in which like reference numerals are used to represent like parts, corresponding to the embodiments of FIGS. 1-6. Referring first to FIG. 10, a side elevational view of a punch 20*a* illustrates the cylindrical shank 22, and shows a front view of the teardrop shaped ball receiving opening or recess 25 formed on the shank. The punch 20*a* illustrated in FIG. 10 is identical to the punch 20 except for the fact that the punch 20*a* is shown s being substantially cylindrical straight throughout its length.

Figure 7:
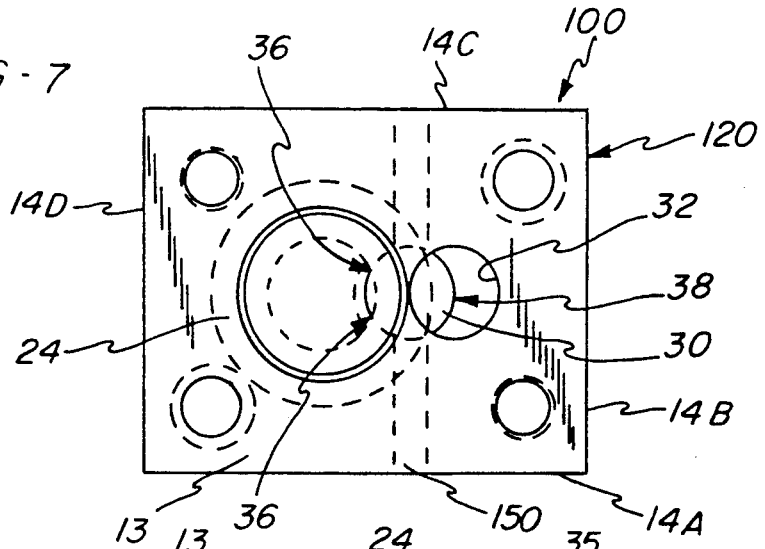
FIG. 7 is a top elevation of another preferred embodiment of the retainer.
Figure 8:
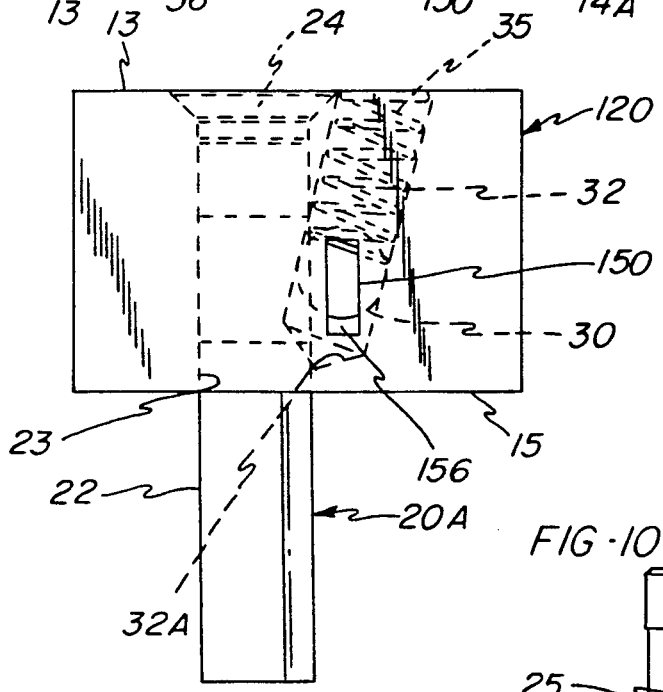
FIG. 8 is a side elevation of the retainer of FIG. 7.

An improved retainer assembly 100 is illustrated in FIGS. 7-8 as having a body 12, with six sides all perpendicular to each other, previously described as a rectangular or orthogonal configuration. However, it is within the scope of the invention to provide a body with a triangular configuration, in plan view, as shown in U.S. Pat. No. 3,563,124.

The body 120 has an upper mounting surface 13, shown in plan view in FIG. 7. It has four side walls or side surfaces represented here by the reference numerals 14*a*, 14*b*, 14*c*, and 14*d*, and a bottom face 15.

The retainer body 120 is formed with a generally cylindrical opening 23 extending normal to the face 15 and proportioned to receive, as a close fit, the cylindrical shank 22 of a punch, such as the punch 20 of FIGS. 1–4 or the punch 20*a* illustrated in FIG. 10.

The inclined ball receiving hole 32, the locking ball 30, and spring 35, including the angular relation of the axis of the hole 32 to the axis of the opening 23, and the angle of the locking ball recess 25, are all as previously identified. Also, the contact points or positions 36 at which the locking ball engages the shank 22, at the recess 25, and the diametrically opposed point 38 at which the ball 30 contacts the wall of the bore 32, are also as previously identified and as illustrated by the arrows in the elevational view of FIG. 7.

In the embodiments of FIGS. 7–12, a generally rectangular ball release access slot 150, which may be formed by Electro Discharge Machining, extends transversely completely through the body 120 in generally normal relation to the axis of the shank opening 123. This slot, which may be rectangular when viewed in cross-section, opens at two transverse surfaces of the body, namely surface 14*a* and the opposite surface 14*c*, through which the slot 150 may be accessed by a tool.

The slot 150 intercepts the inclined ball-receiving hole in non-interfering and in non-intersecting positions with any of the ball contact positions 36 or 38.

The slot 150 is formed with a lower pry wall 156 which forms a support for a prying tool, as previously identified in connection with the wall 56 of the embodiment of FIGS. 4 through 6. This lower wall 156 extends along a plane which is located between the lowermost surface of the ball 30 and the lower or inner end 32*a* of the slot 30, when the ball 30 is in its seated or locking position in the recess 25. This condition is illustrated in FIG. 8, and provides access for the insertion of a tool, through or into either end of the slot 150, and into engagement with the lower portion of the locking ball 30 which is closest to the retainer face 15.

In some circumstances, including that of wear of the parts, the ball 30 may become seated in the recess 25 at a position somewhat lower than that illustrated in FIG. 8 so that the bottom of the ball, as viewed in FIG. 8, could in fact be below the plane of the slot surface 156. Nevertheless, the ball can be easily removed by reason of the fact that the center of the ball would be above the plane of this surface.

Figure 9:
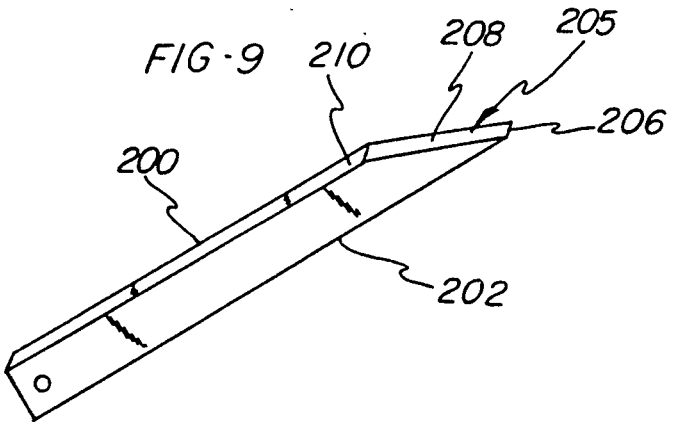
FIG. 9 is a perspective view of the locking ball release bar of this embodiment.
Figure 11:
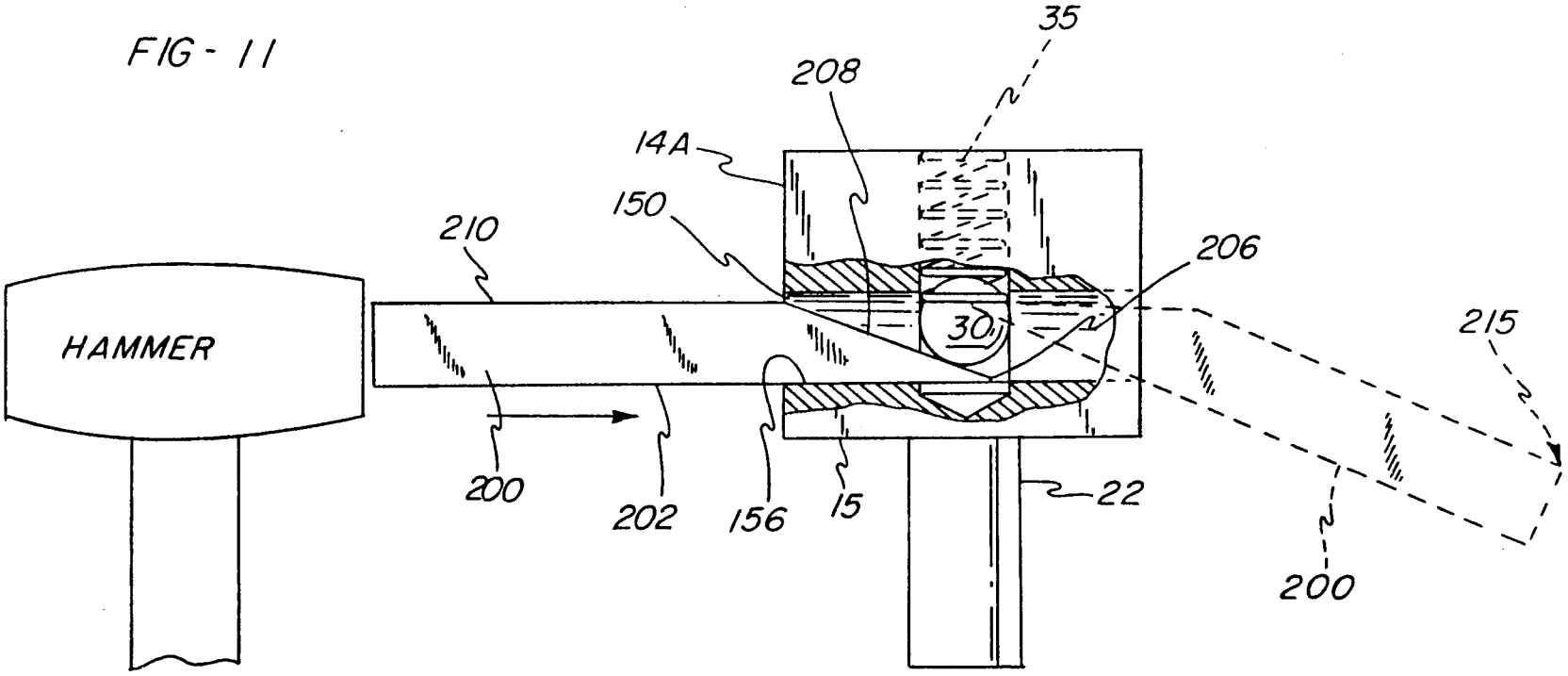
FIGS. 11 illustrates the manner of using the ball release bar in the embodiments of FIGS. 7 and 8, with a portion of the retainer being broken away, also showing in phantom an alternative manner of using the release bar.
Figure 12:
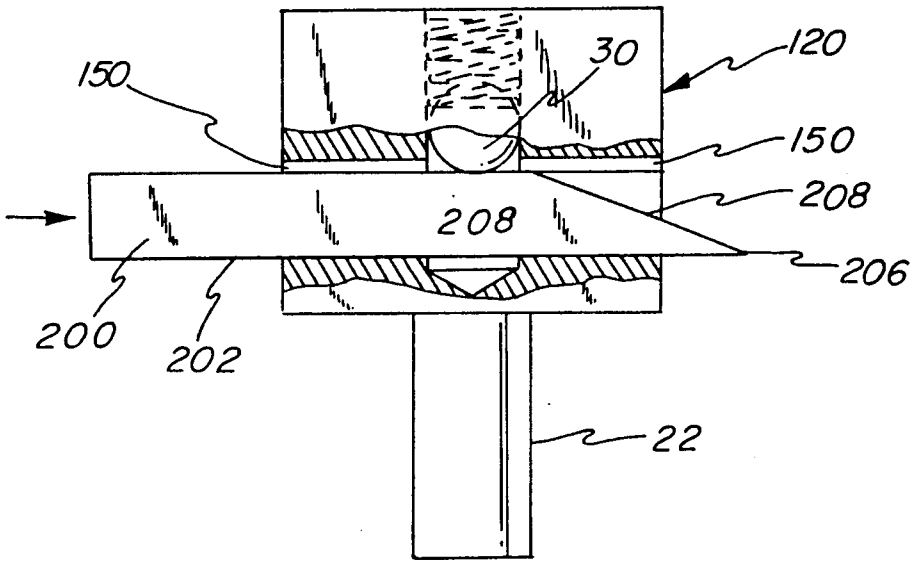
FIG. 12 is a view similar to FIG. 11 showing the release bar moved into a self-holding position with respect to the locking ball.

This embodiment of the invention also includes a specially designed ball-release tool in the form of an elongated slot-conforming bar 200, as shown in FIG. 9 and as further illustrated in FIGS. 11 and 12. The bar 200 is shown as being rectangular in shape over the major portion of its length, and is proportioned to form an easy sliding fit within the slot 150, with a bottom planar surface 202 riding along the bottom wall 156 of the slot.

The bar 202 is formed with a tapered nose 205 on at least one end thereof. The nose 205 forms an inclined ramp or surface 208 extending from a terminal pointed end 206 smoothly to an upper surface 210 of the bar 200. This upper surface otherwise is parallel to the lower surface 202. The tapered surface 208 of the nose 205 provides a ball lifting surface by which the ball 30 may be raised or elevated within its hole 32, against the bias of the spring 35, to the point at which the ball then rests on the surface 210. The first position, at which the point 206 has been inserted in the slot 150, beneath the ball 30, is illustrated in FIG. 11, and the ball lifting position in which the ball is elevated to the point where it rests on the surface 210, is illustrated in FIG. 12.

FIG. 11 also illustrates the means by which the ball 30 may be dislodged in the event that it has become jammed or wedged tightly into the teardrop recess 25. The point 126 is inserted under the ball, and the opposite end of the bar 200 may be tapped, such as by a brass hammer. The bar 200 may be inserted into the opening 150 through either of the opposite wall surfaces 14*a* or 14*c*, as may be convenient to the operator.

The angle which the inclined nose ramp surface 208 forms with the longitudinal axis of the tool is not critical. However, the nose 205 should have a transverse length sufficient to allow it to extend fully across the diameter of the hole 32 during the lifting of the ball 30 from a seated position toward its release position, and an angle of approximately 20° has been found satisfactory.

The 20° angle also provides a nose of sufficient length so as to permit the same to be inserted and used as a pry bar, by simply prying the bar 202 downwardly against the wall 156, to lift the ball when it may easily be lifted or is not jammed or stuck, as shown by the phantom view in FIG. 11, in the direction of the phantom arrow 215. Also, for such prying purposes, a pry bar as illustrated at reference numeral 56, in FIG. 6, may be used.

The operation of the embodiment as illustrated in FIGS. 7 through 12 of the drawings and as described above is also believed to be largely self-evident from the foregoing description. The release tool or bar 200 is inserted into either end of the slot 150, with the surface 202 flat against the wall 156, until the ramp or surface 208 comes into contact with the ball. If the ball is not wedged or jammed in place, simply pushing on the bar will cause the ball to ride up along the surface 208 and permit the bar to be inserted into the position as illustrated in FIG. 12. However, if further effort is needed, the bar 202 can be tapped, thereby applying a direct upward force component to the ball to permit its release from the shank 22. Thereafter, the shank may be removed, while both of the operator's hands are free for this task.

The dual side entrance provided by this embodiment provides both versatility in the removal of punches and tools, and operator safety case of machine malfunction, since the operator's attention and activity are directed to a position alongside the retainer rather than under it. If desired, the retainer may be provided or made with the usual ball release access opening 40, as illustrated in FIGS. 1 and 2, for auxiliary use by a conventional tool. However, the ball release apparatus in accordance with this embodiment permits safe and positive ball release, whether or not there is a conventional access opening or whether or not it is obstructed.

While the forms of apparatus herein described constitute preferred embodiments of this invention, it is to be understood that the invention is not limited to these precise forms of apparatus, and that changes may be made therein without departing from the scope of the invention which is defined in the appended claims.

What is claimed is:

1. An improved ball type punch retainer for holding the shank of a punch and for releasing the same, comprising:

a retainer body having a bottom face surface, side walls and a top mounting surface, a punch shank receiving opening extending into said body through said bottom face surface for receiving a shank of a punch, said retainer body having an elongated locking ball receiving hole aligned along an axis which intersects the axis of said shank opening, a locking ball in said hole movable into locking position with a tear-drop shaped ball-receiving recess formed in the outer periphery of the punch shank, spring means in said hole urging said ball into said locking position, said ball in said locking position engaging said recess at two angularly spaced-apart contact positions on the shank and engaging said retainer body at a third contact position opposite the tool shank recess, a ball release access slot extending transversely completely through said body in generally normal relation to the axis of said shank-receiving so that it is accessible from two opposite of said side walls of said body and in non-intersecting relation to said contact positions, a portion of said slot closest to said bottom face surface being located between said ball in its locking position and said bottom face surface, to provide access for a ball release tool inserted through said slot from either of opposite said side walls and into engagement with a portion of said locking ball closest to said bottom face surface, for lifting said locking ball against said spring means out of engagement with the punch shank.

2. The improved ball-type punch retainer of claim 1 further comprising said ball release access slot being generally rectangular in cross-section with its longer axis aligned generally parallel with the axis of said cylindrical opening.

3. The ball-type punch retainer according to claim 2 further comprising a ball release tool in the form of an elongated generally rectangular bar, said bar being proportioned to fit within said slot and having an upper ball retaining surface and a lower surface, said bar having a nose at at least one terminal pointed end thereof in the form of a ball-lifting tapered surface extending from the terminal end of said bar adjacent said lower surface to said upper ball retaining surface.

4. A ball-type punch retainer for holding the shank of a punch and for releasing the same, comprising:

a retainer body having a bottom face surface, a punch shank receiving cylindrical opening extending into said body through said bottom face surface for receiving the cylindrical shank of a punch, said retainer body also having a side wall formed in generally orthogonal relation to said bottom face surface, said retainer body having an elongated locking ball-receiving hole extending therethrough along an axis which intersects the axis of said shank opening, a locking ball in said hole movable into a locking position with a tear-drop shaped ball-receiving recess formed in the side of a punch shank, spring means in said hole urging said ball into said locking position, said ball in said locking position engaging the tool shank in the ball-receiving recess at two angularly spaced points on the shank and engaging said retainer body at said hole at a third point spaced diametrically opposite the tool shank recess, and a generally rectangular ball release access slot having its longer axis aligned generally parallel with the axis of said cylindrical opening, said slot extending transversely through said body and opening at opposite lateral sides thereof and through said ball-receiving hole in non-intersecting relation to said points, a lower wall portion of said slot closest to said bottom face surface being located between said ball and said bottom face surface when said ball is in said locking position thereby providing access for a tool inserted from either end of said slot into engagement with a portion of said locking ball closest to said bottom face surface, for lifting said locking ball against said spring means and out of engagement with the punch shank.

5. In a retainer assembly including a retainer body in which a cylindrical shank of a punch extends through an opening in a face surface of said body, a tapered ball seating recess is formed in said cylindrical shank, and a locking ball is received in an elongated ball receiving hole in said body for coaction with said ball seating recess, said elongated ball-receiving hole having an axis which is inclined to the axis of said cylindrical shank, said ball being movable in said hole between a retracted punch releasing position and a punch locking position in which a portion of said ball is received in the seating recess and contacts the punch shank at two angularly spaced contact points and contacts said retainer at a third contact point angularly spaced from said two contact points, and a compression spring is received with said hole urging said ball into said locking position, the improvement in a ball release arrangement comprising:

said retainer body having an outer side wall which is formed orthogonally to said face surface, means in said retainer body forming a tool access slot, said slot extending through said outer side wall of said retainer body and opening into said ball-receiving hole at a location adjacent said ball when said ball is at said locking position, and in non-interfering relation to said ball contact positions, the end of said slot nearest said retainer body face surface forming a pry wall against which a ball-lifting tool may be leveraged to provide for sliding movement of said ball in said hole against said compression spring for the release of said punch from said retainer body, means defining a retention hole for a keeper pin, said retention hole positioned laterally adjacent said slot at an end of said slot remote from said pry wall and extending into intersecting relation with said ball receiving hole providing for the insertion of the keeper pin for holding said ball in said releasing position.

* * * * *

UNITED STATES PATENT AND TRADEMARK OFFICE

CERTIFICATE OF CORRECTION

PATENT NO. : 5,197,368

DATED : March 30, 1993

INVENTOR(S) : David G. Meyer and Robert L. Shadowens

It is certified that error appears in the above-identified patent and that said Letters Patent is hereby corrected as shown below:

In the drawing, Sheet 2, Figure 6, the reference numeral 55 should be applied to the elongated pry tool below the keeping pin 62.

Column 6, line 56, cancel "12" and insert -- 120 --.

Column 7, line 17, cancel "123" and insert -- 23 --;
line 32, cancel "slot 30" and insert -- hole 32 --;
line 55, cancel "202" and insert -- 200 --.

Column 8, line 4, cancel "126" and isnert -- 206 --;
line 19, cancel "202" and insert -- 200 --;
line 24, cancel "56" and insert -- 55 --;
line 37, cancel "202" and insert -- 200 --.

Signed and Sealed this

Twenty-first Day of June, 1994

Bruce Lehman

*Attest:*

BRUCE LEHMAN

*Attesting Officer*

*Commissioner of Patents and Trademarks*